US005407497A

United States Patent [19]

Hassan et al.

[11] Patent Number: 5,407,497

[45] Date of Patent: Apr. 18, 1995

[54] METHOD OF HEAT TREATMENT FOR TWO WELDED-TOGETHER PARTS OF DIFFERENT STEEL ALLOY GRADES

[75] Inventors: Alain Hassan; Jacques Comon, both of Paris, France

[73] Assignee: Gec Alsthom Electromecanique SA, Paris, France

[21] Appl. No.: 189,741

[22] Filed: Feb. 1, 1994

[30] Foreign Application Priority Data

Feb. 5, 1993 [FR] France ..... 93 01305

[51] Int. Cl.[6] ..... C21D 9/50

[52] U.S. Cl. ..... 148/529

[58] Field of Search ..... 148/529, 527, 528

[56] References Cited

U.S. PATENT DOCUMENTS 2,133,926 10/1938 Ransom et al. .

FOREIGN PATENT DOCUMENTS 673222 1/1930 France .

OTHER PUBLICATIONS

J. Brozda, "Structure and Properties of Electroslag Welds Following Heat Treatment", *Welding International*, vol. 6, No. 3, 1992, pp. 173–180.

D. E. Tasak et al, "Structure and Properties of Electroslag Welds Following Heat Treatment", *Welding International*, vol. 2, No. 2, 1988, pp. 130–134.

*Primary Examiner*—Deborah Yee

*Attorney, Agent, or Firm*—Sughrue, Mion, Zinn, Macpeak & Seas

[57] ABSTRACT

A method of heat treatment for two welded-together parts of different steel alloy grades, the first part, called A, having critical heating transformation temperatures $AC_1A$ and $AC_3A$ and an optimum post-welding treatment temperature $\theta_A$ which is lower than $AC_1A$, the second part, called B, having critical heating transformation temperatures $AC_1B$ and $AC_3B$, which are respectively lower than $AC_1A$ and $AC_3A$ and an optimum post-welding treatment temperature $\theta_B$ which is lower than $AC_1B$ and $\theta_A$, wherein a first heat treatment cycle is carried out at said temperature $\theta_A$ followed by a second heat treatment cycle at a temperature $\theta_B$. Between the two cycles, the temperature is reduced to below 100° C.

3 Claims, 1 Drawing Sheet

METHOD OF HEAT TREATMENT FOR TWO WELDED-TOGETHER PARTS OF DIFFERENT STEEL ALLOY GRADES

The present invention relates to a method of heat treatment for two welded-together parts made of different grades of steel alloy.

BACKGROUND OF THE INVENTION

After two steel alloy parts have been welded together, it is usual to proceed with heat treatment known as stress-relieving treatment.

This treatment has two aims:

- to eliminate or at least reduce the internal stresses of thermal origin which appear during the cooling and consequent solidification of the welded joint, and
- to temper the solidified metal and the adjacent zone of base metal which has also been affected by temperature, so as to improve the very mediocre ductility of these zones while the weld is in the unfinished condition.

This heat treatment generally consists simply of annealing at a temperature just below the first critical heating transformation temperature, known as $AC_1$. Depending on the nature of the steel constituting the welded joint, this temperature lies somewhere in the range between 550° C. and 750° C. It is carefully chosen so as to be sufficiently high as to achieve the effects of relieving stress and of tempering, whilst at the same time being limited so as not to exceed that temperature $AC_1$ at which the heating transformation begins nor to reach the temperature of metallurgical annealing previously experienced by the parts to be welded together, so as not to affect the properties of the base metal.

Thus, for each grade of steel, there exists an optimum temperature for heat treatment after welding.

When two steel parts of different grades are to be welded together, the choice of treatment temperature is a difficult problem. It is therefore known to use, as the treatment temperature, a temperature which is intermediate between the optimum temperatures of the two steels and which is therefore too high for the steel of lower optimum treatment temperature or, more usually, to use the temperature which corresponds to that one of the two steels which has the lower optimum treatment temperature, in which case the temperature is therefore too low for the other steel.

OBJECT AND SUMMARY OF THE INVENTION

The present invention therefore provides a new method of heat treatment for two welded-together parts of different steel alloy grades, the first part, called A, having critical heating transformation temperatures $AC_1A$ and $AC_3A$ and an optimum post-welding treatment temperature $\theta_A$ which is lower than $AC_1A$, the second part, called B, having critical heating transformation temperatures $AC_1B$ and $AC_3B$, which are respectively lower than $AC_1A$ and $AC_3A$ and an optimum post-welding treatment temperature $\theta_B$ which is lower than $AC_1B$ and $\theta_A$, wherein a first heat treatment cycle is carried out at said temperature $\theta_A$ followed by a second heat treatment cycle at a temperature $\theta_B$, the temperature being reduced to below 100° C. between the two cycles.

BRIEF DESCRIPTION OF THE DRAWINGS

In a particular implementation, said first treatment cycle, at the temperature $\theta_A$ exceeds the temperature $AC_1B$, the complete treatment therefore constituting, for material B, an inter-critical treatment.

MORE DETAILED DESCRIPTION

Figure 1:
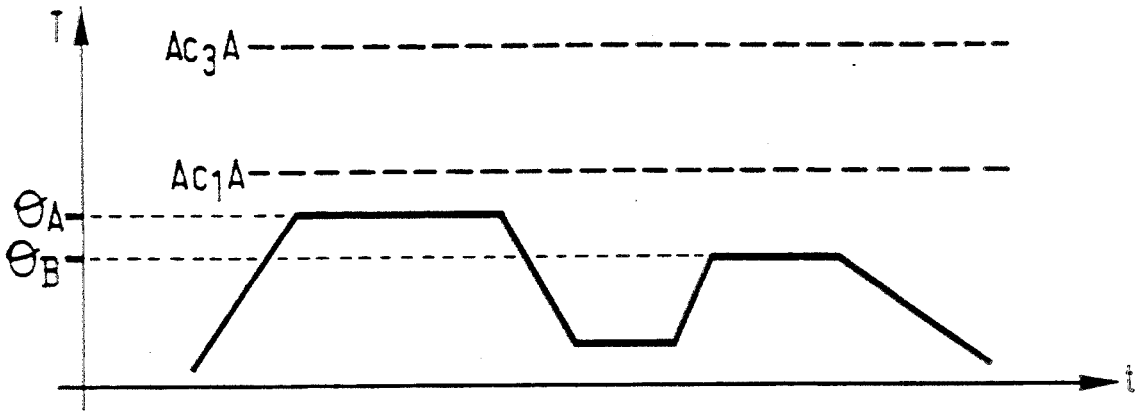
FIGS. 1 and 2 are diagrams showing the method of treatment of the invention.

Thus, a graph of the heat treatment according to the invention can be seen by referring to FIG. 1. The same graph is carried over into FIG. 2. It can be seen that the heat treatment is composed of two cycles: a first cycle at temperature $\theta_A$ and a second cycle at temperature $\theta_B$.

FIG. 1 shows the start and finish critical heating transformation temperatures $AC_1$ and $AC_3$ for an alloy steel A. These two temperatures are therefore designated as: $AC_1A$ and $AC_3A$.

Figure 2:
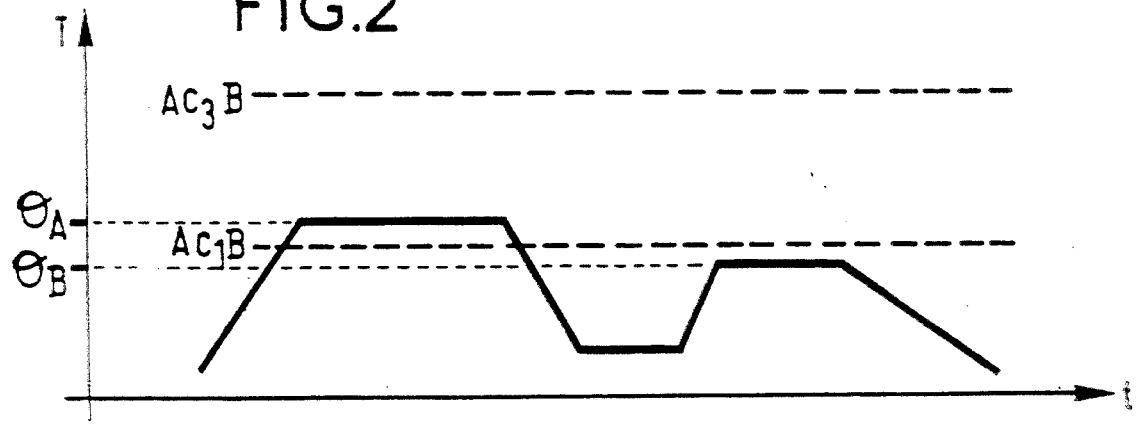

FIG. 2 shows the start and finish critical heating transformation temperatures $AC_1$ and $AC_3$ for an alloy steel B which is of a different grade from the previous steel. These two temperatures are therefore designated as: $AC_1B$ and $AC_3B$.

Temperature $\theta_A$, lower than $AC_1A$, is the optimum post-welding treatment temperature for steel A.

Temperature $\theta_B$, lower than $AC_1B$ and $\theta_A$, is the optimum post-welding treatment temperature for steel B.

If the two figures are superimposed, it can be seen that $AC_1B$ is lower than $AC_1A$ and that $AC_3B$ is lower than $AC_3A$.

The invention therefore consists in proceeding with this double heat treatment at temperatures $\theta_A$ and $\theta_B$ after two steel alloy parts of respective grades A and B have been welded together, with the temperature being lowered to below 100° C. between the two treatments at $\theta_A$ and $\theta_B$.

Thus, for steel A, FIG. 1, this double cycle at $\theta_A$ and $\theta_B$ has the same effect as a single treatment at the temperature $\theta_A$ corresponding to the optimum post-welding heat treatment temperature for that steel and the second cycle at $\theta_B$ has no effect.

By contrast, for steel B, FIG. 2, the first cycle at $\theta_A$ exceeds the optimum temperature $\theta_B$ for that steel, and in the example given, that temperature $\theta_A$ exceeds even the temperature $AC_1B$, i.e. during this cycle, this steel begins to be transformed into austenire. During the subsequent cooling, this austenire, which is strongly carburized, is transformed into martensite, a hard and brittle constituent of quenching. During the second cycle at the temperature $\theta_B$ (or close to $\theta_B$), this quenched constituent is tempered and its tensile strength is greatly improved.

A double cycle of this type, for steel B, is a treatment known as "inter-critical" which is capable of producing very ductile micrographic structures.

As far as the deposited filler metal is concerned, depending on whether its chemical analysis is similar to component A or B, its behavior will be that of one or other of those grades of steel.

Thus, because of this double cycle at temperatures $\theta_A$ and $\theta_B$, the essential objectives of the post-welding heat treatment are achieved, both in the deposited filler metal and in the two joined materials.

Generally, it is advantageous that at least the first thermal cycle at $\theta_A$° C. should be applied locally, i.e. affecting only the deposited metal and the base metal immediately adjacent on either side. Thus, material B outside the weld region is unaffected by the inter-critical treatment and conserves its initial properties.

An application of the method of the invention to a turbine rotor is described with reference to FIG. 3.

It is required to form an "HP-LP" rotor by joining together two parts made of different grades of steel A and B. One is chosen for its properties when hot (the high pressure part HP) and the other for its properties when cold (the low pressure part LP).

Part HP(A) is for example a 1% Cr Mo V steel having the following composition:

C=0.23
Ni=0.6
Cr=1
Mo=1
V=0.3.

For this steel, the temperature $AC_1(A)$ is 750° C. and the temperature $AC_3(A)$ is 900° C., its optimum post-welding treatment temperature $\theta_A$ being 670° C.

Its yield point Re=500 MPa, its ultimate tensile stress Rm=650 MPa.

Part HP(B) is for example a 3% Ni Cr Mo V steel having the following composition:

C=0.23
Ni=3.0
Cr=1.75
Mo=0.5
V=0.1
its temperatures $AC_1(B)$=630° C.
$AC_3(B)$=810° C.
$\theta_B$=600° C.
Re=680 MPa
Rm=800 MPa.

Figure 3:
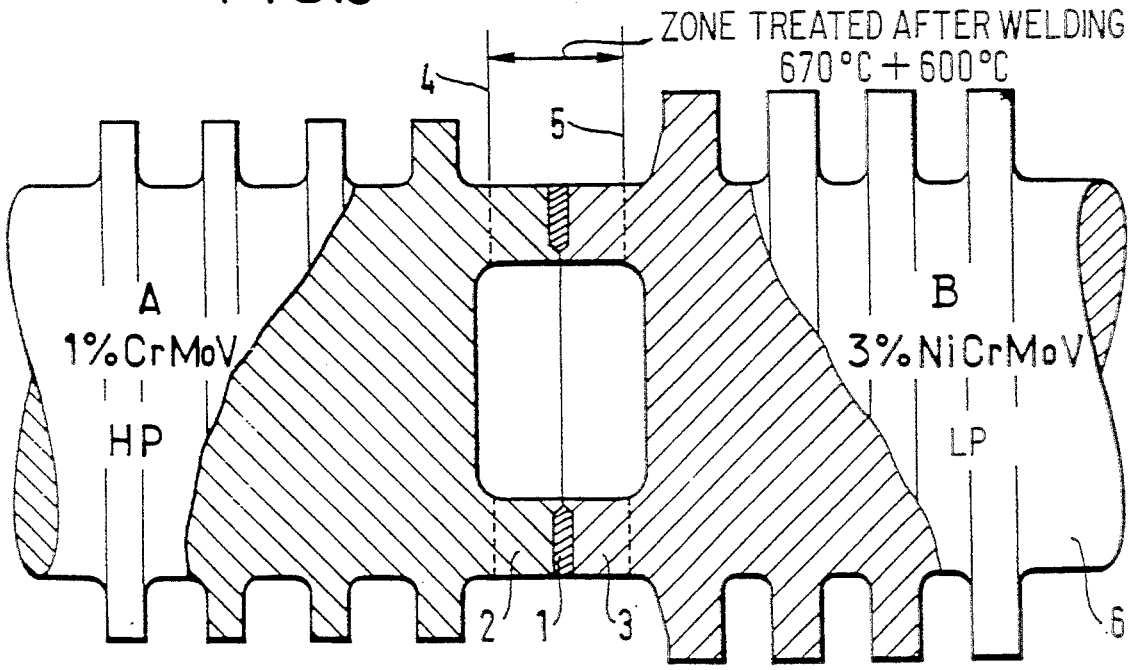
FIG. 3 is a partial schematic view of two welded-together portions of a rotor of a turbomachine, the two welded-together portions being made of two different grades of alloy steel, this serving as a concrete example for describing the method of the invention.

The deposited filler metal, designated as 1 in FIG. 3, is of the type: 2¼ Cr 1 Mo which, following heat treatment at 670° C., is capable of presenting the following elasticity and fracture characteristics:

Re=500 MPa
Rm=650 MPa.

After the two parts A and B have been welded together, the applied heat treatment is a local treatment affecting only the welded joint 1 and the weld regions 2 and 3 which have been outlined in the figure by dotted lines 4 and 5.

The treatment applied to this zone is as follows: first heating cycle at $\theta_A$=670° C. for five hours, then cooling to 20° C., second heating cycle at $\theta_B$=600° C. for five hours, then cooling.

HP part A in its entirety, and the deposited metal 1, retain their normal mechanical characteristics after this double cycle.

Outside the weld region, LP part B, designated as 6 retains its original mechanical characteristics, as the heating at $\theta_A$=670° C. does not affect it.

Finally, the weld region 3 of LP part B undergoes an inter-critical treatment (corresponding to FIG. 2) which gives it excellent strength and very good ductility. By contrast, its tensile characteristics Re and Rm are reduced by this treatment and fall to the following values: Re=500 MPa Rm=650 MPa, these being perfectly acceptable, as these characteristics are the same as those of the other weld region 2, on the HP side, which are subjected to the same conditions in service.

All the zones of the assembled part as treated according to the double cycle of the invention at values $\theta_A$ and $\theta_B$ therefore have the required properties.

We claim:

1. A method of heat treatment following for two welded-together parts of different steel alloy grades, the first part, called A, having critical heating transformation temperatures $AC_1A$ and $AC_3A$ and an optimum post-welding treatment temperature $\theta_A$ which is lower than $AC_1A$, the second part, called B, having critical heating transformation temperatures $AC_1B$ and $AC_3B$, which are respectively lower than $AC_1A$ and $AC_3A$ and an optimum post-welding treatment temperature $\theta_B$ which is lower than $AC_1B$ and $\theta_A$, wherein a first heat treatment cycle is carried out at said temperature $\theta_A$ followed by a second heat treatment cycle at a temperature $\theta_B$, the temperature being reduced to below 100° C. between the two cycles.

2. A method of heat treatment according to claim 1, wherein said first treatment cycle, at the temperature $\theta_A$ exceeds the temperature $AC_1B$, the complete treatment therefore constituting, for material B, an inter-critical treatment.

3. A method according to claim 1, wherein at least the first treatment cycle affects only the deposited filler metal (1) and the immediately adjacent portions (2, 3) of the two welded-together parts (A, B).

* * * * *